US009221560B2

(12) United States Patent
Dong et al.

(10) Patent No.: US 9,221,560 B2
(45) Date of Patent: Dec. 29, 2015

(54) VIBRATING DEVICE FOR UNIFORM FILLING OF GRANULAR ORNAMENTS

(71) Applicant: Beifa Group Co., Ltd., Ningbo, Zhejiang (CN)

(72) Inventors: Cailiang Dong, Ningbo (CN); Feng Zhu, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 330 days.

(21) Appl. No.: 13/720,825

(22) Filed: Dec. 19, 2012

(65) Prior Publication Data

US 2013/0167487 A1 Jul. 4, 2013

(30) Foreign Application Priority Data

Dec. 29, 2011 (CN) ..... 2011 1 0449642

(51) Int. Cl.

| | |
|---|---|
| ***B65B 1/22*** | (2006.01) |
| ***B43K 8/00*** | (2006.01) |
| ***B43K 15/02*** | (2006.01) |
| ***B43K 23/12*** | (2006.01) |
| ***B43K 29/00*** | (2006.01) |
| ***B43K 5/00*** | (2006.01) |
| ***B43K 7/00*** | (2006.01) |
| ***B06B 1/10*** | (2006.01) |
| *A44C 17/04* | (2006.01) |

(52) U.S. Cl.

CPC ... *B65B 1/22* (2013.01); *B06B 1/10* (2013.01); *B43K 5/005* (2013.01); *B43K 7/005* (2013.01); *B43K 8/003* (2013.01); *B43K 15/02* (2013.01); *B43K 23/12* (2013.01); *B43K 29/00* (2013.01); *A44C 17/043* (2013.01)

(58) Field of Classification Search

CPC ..... B06B 1/10; B65B 1/22; B43K 15/00
USPC ..... 141/11–12, 71–80; 53/525
See application file for complete search history.

(56) References Cited

U.S. PATENT DOCUMENTS

| | | | | |
|---|---|---|---|---|
| 735,209 | A * | 8/1903 | Carnochan | 141/72 |
| 751,257 | A * | 2/1904 | Carnochan | 141/72 |
| 2,160,735 | A | 5/1939 | Hoffer | |

(Continued)

FOREIGN PATENT DOCUMENTS

| | | |
|---|---|---|
| DE | 2017459 | 10/1971 |
| DE | 2226920 | 12/1973 |
| SU | 1444172 A1 | 12/1988 |

*Primary Examiner* — Jason K Niesz
*Assistant Examiner* — Timothy P Kelly
(74) *Attorney, Agent, or Firm* — Christensen O'Connor Johnson Kindness PLLC

(57) ABSTRACT

A vibrating device for uniformly filling granular ornaments includes a base, a vibration platform, a motor, a first vibrating assembly for generating vibration in an up-down direction, and a second vibrating assembly for generating vibration in a left-right direction. The vibration platform is articulated at the base and provided with multiple through-holes for holding workpieces, such as pen caps. The motor is fixedly mounted at the base. The first vibrating assembly and the second vibrating assembly both are provided between the motor and the vibration platform. The motor drives the first vibrating assembly to make the vibration platform vibrate in the up-down direction, and at the same time drives the second vibrating assembly to make the vibration platform vibrate in the left-right direction. Thus, granular ornaments can fill the cavities of pen caps located within the through holes in the vibration platform.

12 Claims, 2 Drawing Sheets

(56) References Cited

U.S. PATENT DOCUMENTS

| | | | | |
|---|---|---|---|---|
| 2,405,367 | A | | 8/1946 | Nichols, Jr. |
| 2,672,630 | A | | 3/1954 | Bitzer |
| 2,969,030 | A | | 1/1961 | Kahn |
| 3,246,502 | A | | 4/1966 | Brignoli |
| 3,281,933 | A | | 11/1966 | Fehling |
| 3,496,627 | A | | 2/1970 | Mazzier |
| 3,578,142 | A | | 5/1971 | Burgess, Jr. |
| 3,581,378 | A | | 6/1971 | Jozens |
| 3,620,264 | A | | 11/1971 | Klein |
| 3,708,854 | A | | 1/1973 | Nalbach |
| 3,729,269 | A | | 4/1973 | Koeln |
| 3,776,673 | A | | 12/1973 | DeGroft |
| 3,800,496 | A | | 4/1974 | Bardet |
| 3,815,726 | A | | 6/1974 | Klein |
| 3,862,486 | A | | 1/1975 | McArdle |
| 3,889,336 | A | | 6/1975 | Buchanan |
| 3,959,870 | A | | 6/1976 | Klein |
| 4,047,276 | A | | 9/1977 | Albers |
| 4,071,949 | A | | 2/1978 | Ross |
| 4,195,399 | A | | 4/1980 | Rasmussen |
| 4,259,780 | A | | 4/1981 | Crawford |
| 4,431,102 | A | | 2/1984 | Bittner |
| 4,476,997 | A | | 10/1984 | Lacroix |
| 4,498,234 | A | | 2/1985 | Greslin |
| 4,518,972 | A | | 5/1985 | Gunderson |
| 4,576,286 | A | | 3/1986 | Buckley |
| 4,635,338 | A | | 1/1987 | Walsh |
| 4,747,294 | A | | 5/1988 | Schwartz |
| 4,873,760 | A | | 10/1989 | Watanabe |
| 4,875,374 | A | * | 10/1989 | Pinson ..... 73/663 |
| 4,885,701 | A | | 12/1989 | Gunderson |
| 4,929,087 | A | * | 5/1990 | Brigolle ..... 366/111 |
| 5,016,346 | A | | 5/1991 | Gerst |
| 5,031,306 | A | | 7/1991 | Schmitt |
| 5,044,539 | A | | 9/1991 | Hargreaves |
| 5,172,994 | A | | 12/1992 | Brown |
| 5,469,204 | A | | 11/1995 | Kim |
| 5,479,968 | A | | 1/1996 | Sanchez |
| 5,938,361 | A | | 8/1999 | Yasunaga |
| 6,076,987 | A | | 6/2000 | Sekine |
| 6,363,602 | B1 | | 4/2002 | Clark |
| 6,425,702 | B1 | | 7/2002 | Brunetti |
| 6,725,539 | B2 | | 4/2004 | Parkhill |
| 6,755,222 | B2 | | 6/2004 | Kondo |
| 7,076,866 | B2 | | 7/2006 | Iannucci |
| 7,111,379 | B2 | | 9/2006 | Chen |
| 8,061,791 | B2 | | 11/2011 | Iftime |
| 8,123,424 | B2 | | 2/2012 | Chang |
| 8,201,590 | B2 | * | 6/2012 | Houzego ..... 141/73 |
| 8,226,073 | B2 | | 7/2012 | Li |
| 8,844,581 | B2 | | 9/2014 | Higai |
| 2006/0010680 | A1 | | 1/2006 | Chen |
| 2010/0229737 | A1 | | 9/2010 | Ouchi |
| 2010/0269322 | A1 | | 10/2010 | Jendrichowski |
| 2014/0260502 | A1 | | 9/2014 | Wang |

* cited by examiner

VIBRATING DEVICE FOR UNIFORM FILLING OF GRANULAR ORNAMENTS

TECHNICAL FIELD

The disclosed embodiments relate to a vibrating device, and in particular, a vibrating device for uniformly filling granular ornaments.

BACKGROUND

Many people choose a pen as a gift for their relatives or friends. The barrel and cap of gift pens are usually made from a noble metal. Sweat may adhere to the pen barrel and the pen cap. The sweat can corrode the noble metal and degrade the appearance of the pen over time. Therefore, if the owner of the pen wants to keep the appearance of the pen unchanged, for example, to represent that family love or friendship will never fade, the pen owner's only choice is to keep the pen as merely an ornament. Therefore, the pen's utility as a writing instrument is largely reduced.

Realizing the problem with pens made from metal, pens used as gifts may now include granular ornaments. The pen barrel and pen cap can be made of a transparent plastic material to display the granular ornaments. A cavity provided within the pen barrel and/or pen cap is filled with the granular ornaments. Granular ornaments may include crystals, diamonds, and gems, among other materials. The pen has both an appealing appearance and is useful. With conventional processes, the operation of filling the cavity of the pen cap with granular ornaments is performed manually. The process involves tapping the pen on the worktable to create vibrations in order to fill the cavities with the granular ornaments. However, due to limitations of manually tapping the pens on the worktable, the granular ornaments may become unevenly distributed. Therefore, the appearance of the pen suffers, and substantial gaps may appear among the granular ornaments after using the pen. Additionally, the granular ornaments may shake or come loose once inside the pen cap, scratching the transparent material. This results in damage to the pen cap and an unappealing appearance after a period of extended use.

SUMMARY

Disclosed herein is a vibrating device that, in at least one embodiment, may be used for uniformly filling granular materials within workpieces, such as pens, pen barrels, and pen caps, for example.

The vibrating device includes a platform adapted to hold a plurality of workpieces filled with granular materials, a base coupled to the platform, wherein the coupling between the base and platform is adapted to articulate in at least two directions substantially orthogonal to each other. The vibrating device includes a first vibrating assembly that vibrates the platform along the first direction and a second vibrating assembly that vibrates the platform along the second direction. The vibrating device includes a driver coupled to both the first and second vibration assemblies, wherein vibration in the first and second directions is simultaneous.

The first direction can be an up-down direction, and the second direction can be a left-right direction.

The platform may include multiple through-holes on the top surface for holding the workpieces.

The driver may include a motor that is fixedly mounted to the base, and the first vibration assembly and the second vibrating assembly are coupled between the motor and the platform.

The first vibrating assembly may include a first cam and a first follower. The second vibrating assembly may include a second cam and a second follower. The first cam and the second cam can be coupled with a rotating shaft of the driver. The first follower and the second follower can be coupled to the undersurface of the platform.

The first cam may be adapted to rotate with the motor shaft, and the first follower translates or moves in the same plane in which the first cam rotates. The second cam may also rotate with the motor shaft, and the second follower translates or moves in a plane substantially perpendicular to the plane in which the second cam rotates.

The peripheral wall of the first cam may contact the first follower, and an end face of the second cam may contact the second follower.

The peripheral wall of the first cam may include at least one lobe, and the end face of the second cam may include at least one lobe.

The first follower may include a wheel in contact with the first cam, and the second follower may include a wheel in contact with the second cam.

The first cam can be a radial cam, and the second cam can be an end face cam. The first cam and the second cam can be coaxially coupled with the rotating shaft of the driver.

In other embodiments, at least one of the first cam or the second cam is eccentrically coupled with the rotating shaft of the driver.

The first follower may include a first supporting rod, and the second follower may include a second supporting rod. Both supporting rods can be fixedly coupled to the undersurface of the platform. A first coupling shaft is coupled at the lower end of the first supporting rod, and the longitudinal axis of the first supporting rod is perpendicular to the axis of the first coupling shaft. A first follower wheel is coupled at the first coupling shaft. A second coupling shaft may be coupled at the lower end of the second supporting rod, and the longitudinal axis of the second supporting rod can be perpendicular to the axis of the second coupling shaft. A second follower wheel is coupled to the second coupling shaft, and the axis of the first coupling shaft is perpendicular to the axis of the second coupling shaft.

In at least one embodiment, the vibration device may be used for vibrating a plurality of pen caps containing granular materials within a cavity.

As noted, in at least one embodiment, a first vibrating assembly is provided between the motor and the vibration platform to make the vibration platform vibrate in an up-down direction, and at the same time a second vibrating assembly is provided between the motor and the vibration platform to make the vibration platform vibrate in a left-right direction. Thus, granular ornaments can fill the cavities of pen caps located in through-holes in the vibration platform. The granular ornaments can be distributed compactly and evenly under vibration forces in the up-down direction and the left-right direction. Therefore, the appearance of the pen can be improved. Furthermore, the vibration device has a simple structure, is convenient to use, and is reliable to operate. The vibration device may apply to other applications as well.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The disclosed embodiments provide a vibrating device. In various embodiments, the vibrating device may be used to uniformly fill granular materials in workpieces, such as pen caps, pen barrels, or other workpieces.

Figure 1:
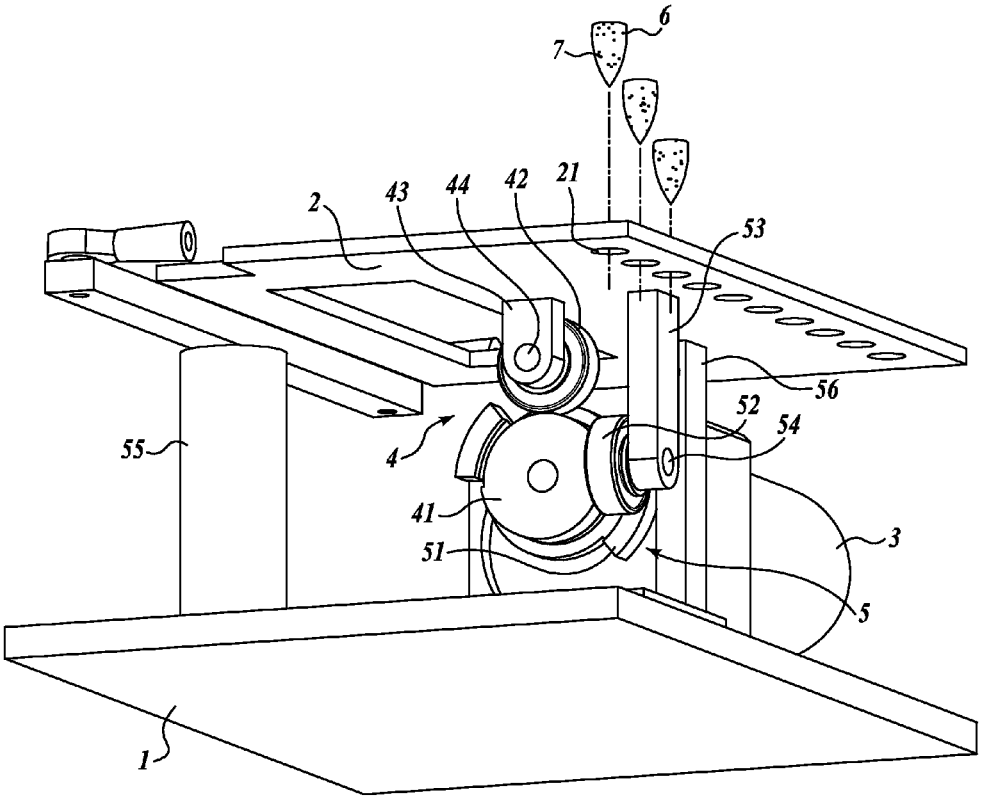
FIG. 1 schematically shows the structure of a vibrating device.

As shown in FIG. 1, a vibrating device may include a base 1, a vibration platform 2, a driver motor 3, a first vibrating assembly 4 for vibrating the platform 2 in an up-down direction, and a second vibrating assembly 5 for vibrating the platform 2 in a left-right direction. The vibration platform 2 is articulated in relation to the base 1 and is provided with multiple through-holes 21 for placing pen caps therein, for example. The motor 3 is fixedly mounted at the base 1.

The first vibrating assembly 4 and the second vibrating assembly 5 are both coupled between the motor 3 and the vibration platform 2. The motor 3 drives the first vibrating assembly 4 to make the vibration platform 2 vibrate in the up-down direction, and at the same time drives the second vibrating assembly 5 to make the vibration platform 2 vibrate in the left-right direction. Thus, the vibration platform 2 vibrates in the up-down direction and the left-right direction simultaneously.

The pen caps 6 with cavities in which granular materials 7 are provided are located in the through-holes 21 at the top surface of the vibration platform 2. The pen caps 6 are tapered so that they can be restrained in the through-holes 21. The pen caps 6 can be filled with the granular materials 7 by means of a hopper (not shown) that can dispense a predetermined amount of granular materials 7 in each pen cap 6. Granular materials 7 may include ornamental or decorative materials including crystals, diamonds, and gems, among other materials. Since the vibration platform 2 vibrates in the up-down direction and the left-right direction, the granular ornaments can be distributed within the cavities of the pen caps compactly and evenly under the vibration forces. Thus, the appearance of the pens can be improved greatly.

The frequencies of the up-down vibration generated by the first vibrating assembly 4 and the left-right vibration generated by the second vibrating assembly 5 may be determined by the rotating speed of the motor 3. The frequency of the vibrations may be adjustable by adjusting the speed of the motor 3.

In at least one embodiment, the first vibrating assembly 4 includes a first cam 41 and a first follower 42, and the second vibrating assembly 5 includes a second cam 51 and a second follower 52. In at least one embodiment, the followers include guide roller wheels. The first cam 41 and the second cam 51 may be coaxially coupled with the rotating shaft of the motor 3. A first supporting rod 43 is fixedly coupled to the undersurface of the vibration platform 2 at a position distanced from the centerline between the two struts 55 and 56.

In order to provide an up-down vibration, the platform 2 can be made to pivot around an axis, and the first vibrating assembly 4 applies a force offset from this axis. For example, the vibration platform 2 can be flexibly coupled to the base 1 using the first and second struts 55 and 56. The first and second struts 55 and 56 may be placed on a centerline across the width of the vibration platform 2. The first vibration assembly 4 may apply a force offset from this centerline so as to cause the platform 2 to pivot or rotate at the centerline, such that part of the vibration platform may pivot up while part of the platform may pivot down. The axis of rotation can be at the platform 2 or at the base 1 or anywhere in between that is provided with a flexible coupling. Further, a flexible coupling between the vibration platform 2 and the base 1 may be biased so as to maintain the follower in contact to its respective cam surface. That is, a spring-like force is applied to the follower 43. For example, the struts 55 and 54 can include an elastic hard rubber coupling that returns the follower 43 to the cam 41 after an oscillation in the up direction. The spring-like force can come from the coupling itself, or an additional spring may be added to keep the follower in contact with the cam.

A second supporting rod 53 is fixedly coupled to the undersurface of the vibration platform 2. In order to provide a left-right vibration that is perpendicular to the centerline on which the struts 55 and 56 are positioned, the struts 55 and 56 may each have a plurality of flexible couplings. For example, the top of both the struts 55 and 56 may be coupled to the vibration platform 2 using a hard rubber coupling, and the bottom of both the struts 55 and 56 may be coupled to the base 1 also using a hard rubber coupling. The left-right vibration motion is perpendicular to the centerline on which the struts 55 and 56 are located, so two flexible couplings may be used on each of the struts 55 and 56. In this manner, the left-right vibration is decoupled from the up-down vibration and two independent vibrations can be provided. The flexible coupling for allowing left-right vibrations between the vibration platform 2 and the base 1 may be biased so as to maintain the follower in contact to its respective cam surface. That is, a spring-like force is applied to the follower 53 to keep it in contact with the cam 51. This spring-like force can come from the coupling itself, or an additional spring may be added to keep the follower in contact with the cam.

A first coupling shaft 44 is coupled at the lower end of the first supporting rod 43, and the longitudinal axis of the first supporting rod 43 is perpendicular to the axis of the first coupling shaft 44. A first guide wheel 42 is coaxially coupled to the first coupling shaft 44. A second coupling shaft 54 is coupled at the lower end of the second supporting rod 53, and the longitudinal axis of the second supporting rod 53 is perpendicular to the axis of the second coupling shaft 54. A second guide wheel 52 is coaxially coupled to the second coupling shaft 54. The axis of the first coupling shaft 44 is perpendicular to the axis of the second coupling shaft 54 to provide for vibration in two directions.

The first cam 41 and the first guide wheel 42 are located within a same vertical plane and rotate in the same plane. The peripheral wall of the first cam 41 contacts the peripheral wall of the first guide wheel 42. The motor 3 drives the first cam 41 to rotate and impact the first guide wheel 42 in order to make the vibration platform 2 vibrate in the up-down direction, such as pivoting around the centerline, for example.

The vertical plane of the second cam 51 is perpendicular to the vertical plane of the second guide wheel 52, and the end face of the second cam 51 contacts the peripheral wall of the second guide wheel 52. The motor 3 drives the second cam 51 to rotate and impact the second guide wheel 52 in order to make the vibration platform 2 vibrate in the left-right direction. The vibration in the up-down direction is generated by way of the cooperation of the first cam 41 and the first guide wheel 42, and at the same time, the vibration in the left-right direction is generated by way of the cooperation of the second cam 51 and the second guide wheel 52. Therefore, the structure of the vibration device is simple and operates reliably.

Figure 2:
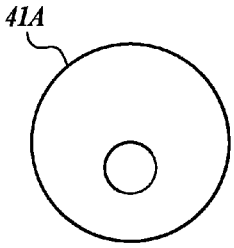
FIG. 2 schematically shows the structure of an eccentric cam.
Figure 3:
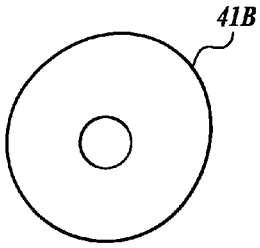
FIG. 3 schematically shows the structure of a radial cam with one lobe.
Figure 4:
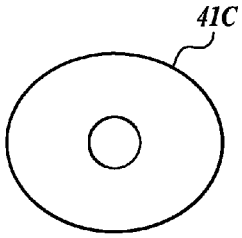
FIG. 4 schematically shows the structure of a radial cam with two lobes.
Figure 5:
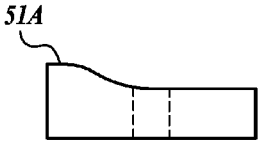
FIG. 5 schematically shows the structure of an end cam with one lobe.
Figure 6:
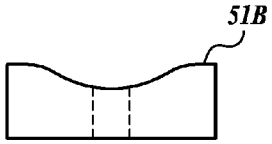
FIG. 6 schematically shows the structure of an end cam with two lobes.

In at least one embodiment, the first cam 41 is a radial cam, and the second cam 51 is an end cam. A radial cam has a profiled edge to convert the rotating motion of the cam to a liner motion of the follower. A radial cam may also include an eccentric cam as shown in FIG. 2. An eccentric cam has a circular shape, but the center of rotation is "off center." That is, the center of an eccentric cam is not coaxially aligned with the motor shaft. Radial cams can have one or more lobes. A lobe is a high spot on the cam surface. Radial cam shapes include an "egg" shape having one lobe or an ellipse shape having two lobes shown in FIGS. 3 and 4, respectively. Unlike the radial cam, an end cam has an end surface profiled to convert the rotating motion of the cam to a linear motion of the follower. The end cam has a face or end surface profiled with one or more lobes. For example, FIG. 5 is a cross section of an end cam showing a face surface with one lobe, while FIG. 6 is a cross section of an end cam showing a face surface with two lobes. Of course, the first cam 41 and the second cam 51 can employ other cam shapes.

As can be appreciated, the guide wheels will impart an impact via the supporting rods to the vibration platform each time the guide wheels pass over a lobe in the respective cams. The vibration amplitude in the up-down direction depends on the first cam 41, and the vibration amplitude in left-right direction depends on the second cam 51. Since the vibration device is employed to fill granular ornaments, good results can be realized by just slightly increasing the vibration frequency of the vibration device and thus large vibration amplitudes are unnecessary.

While illustrative embodiments have been illustrated and described above, it will be appreciated that various changes can be made therein without departing from the spirit and scope of the invention.

The embodiments of the invention in which an exclusive property or privilege is claimed are defined as follows:

1. A vibrating device for uniformly filling granular materials within workpieces, comprising:

a platform configured to hold a plurality of workpieces filled with granular materials;

a base coupled to the platform, wherein the coupling between the base and platform is configured to articulate in a first direction and a second direction substantially orthogonal to the first direction;

a first vibrating assembly that vibrates the platform along the first direction comprising a radial cam and a first follower contacting the radial cam;

a second vibrating assembly that vibrates the platform along the second direction comprising an end face cam and a second follower contacting the end face cam; and a driver coupled to both the first and second vibrating assemblies comprising a rotating shaft, wherein vibration in the first and second directions is simultaneous, wherein the radial cam and the end face cam are coupled with the rotating shaft, and wherein the first follower and the second follower are coupled at the undersurface of the platform.

2. The vibrating device of claim 1, wherein the first direction is an up down direction and the second direction is a left right direction.

3. The vibrating device of claim 1, wherein the platform comprises multiple through-holes for holding workpieces.

4. The vibrating device of claim 1, wherein the driver comprises a motor fixedly mounted to the base, and wherein the first vibrating assembly and the second vibrating assembly are coupled between the motor and the platform.

5. The vibrating device of claim 1, wherein the radial cam rotates and the first follower translates in the same plane in which the radial cam rotates, and wherein the end face cam rotates and the second follower translates in a plane substantially perpendicular to the plane in which the end face cam rotates.

6. The vibrating device of claim 5, wherein a peripheral wall of the radial cam contacts the first follower, and wherein an end face of the end face cam contacts the second follower.

7. The vibrating device of claim 6, wherein the peripheral wall of the radial cam comprises at least one lobe, and wherein the end face of the end face cam comprises at least one lobe.

8. The vibrating device of claim 1, wherein the first follower comprises a wheel in contact with the radial cam, and wherein the second follower comprises a wheel in contact with the end face cam.

9. The vibrating device of claim 1, wherein the radial cam and the end face cam are coaxially coupled with the rotating shaft of the driver.

10. The vibrating device of claim 1, wherein at least one of the radial cam and the end face cam are eccentrically coupled with the rotating shaft of the driver.

11. The vibrating device of claim 1, wherein:

the first follower comprises a first supporting rod and the second follower comprises a second supporting rod;

both the first and second supporting rods are fixedly coupled to the undersurface of the platform;

a first coupling shaft is coupled at the lower end of the first supporting rod;

the longitudinal axis of the first supporting rod is perpendicular to the axis of the first coupling shaft;

a first follower wheel is coupled at the first coupling shaft;

a second coupling shaft is coupled at the lower end of the second supporting rod;

the longitudinal axis of the second supporting rod is perpendicular to the axis of the second coupling shaft;

a second follower wheel is coupled to the second coupling shaft; and the axis of the first coupling shaft is perpendicular to the axis of the second coupling shaft.

12. The vibrating device of claim 1, wherein the platform comprises a plurality of pen caps containing granular materials.

* * * * *